United States Patent [19]

Kurashima

[11] 4,441,234

[45] Apr. 10, 1984

[54] DECORATIVE CUFFLINK

[76] Inventor: Hideo Kurashima, 5-12, Negishi 1-chome, Taito-ku, Tokyo, Japan

[21] Appl. No.: 409,172

[22] Filed: Aug. 18, 1982

[30] Foreign Application Priority Data

Apr. 10, 1982 [JP] Japan ..... 57-52487[U]

[51] Int. Cl.[3] ..... A44B 5/02

[52] U.S. Cl. ..... 24/41; 24/676; 24/108; 24/453

[58] Field of Search ..... 24/40, 41, 42, 43, 44, 24/46, 48, 217 R, 217 W, 218, 221 R, 221 K, 291, 297, 298

[56] References Cited

U.S. PATENT DOCUMENTS

| | | | |
|---|---|---|---|
| 1,199,422 | 9/1916 | Reitzel | 24/218 |
| 1,566,524 | 12/1925 | Dahlgren | 24/218 X |
| 1,586,572 | 6/1926 | Morton . | |
| 2,688,785 | 9/1954 | Carpinella . | |
| 2,786,251 | 3/1957 | Van Buren . | |
| 4,242,776 | 1/1981 | Kurashima . | |
| 4,361,936 | 12/1982 | Kurashima | 24/41 |

FOREIGN PATENT DOCUMENTS

| | | | |
|---|---|---|---|
| 52-3857 | 6/1977 | Japan . | |
| 92677 | 1/1922 | Switzerland | 24/218 |

*Primary Examiner*—William E. Lyddane
*Assistant Examiner*—James R. Brittain
*Attorney, Agent, or Firm*—Cushman, Darby & Cushman

[57] ABSTRACT

The cufflink includes a decorative head element disassembly assembled to a shank and keeper unit. The decorative head element has a hole in which the shaft head with the aid of a spring which is mounted inside the element. Disassembly is achieved by pushing the two parts together, turning one about the shank a quarter turn and letting go. Within the element cavity a vertical rib is medially formed on the rear wall. The rib is horizontally notched intermediate the opening and edge of the element. The bow of the spring is received in the notch and is resiliently loaded by a retainer located at the bow. The securement plate on which the round-tipped projection is mounted in the cavity so as to project outwardly in the hole is formed as a thin, dished portion of the vertical rib.

4 Claims, 17 Drawing Figures

DECORATIVE CUFFLINK

BACKGROUND OF THE INVENTION

The present design relates to a cufflink, more particularly to a cufflink reduced in number of parts, simplified in construction and facilitated in manufacture.

In general, a conventional cufflink is constituted by a decorative head element and a shank and keeper unit. The shank and keeper unit is provided with a keeper which is movable between the axial direction of the unit and the direction normal thereto. For installation of the cufflink the unit is passed through aligned holes on opposite ends of the shirt cuff with this keeper laid flat axially. Then the keeper is turned ninety degrees from position to the direction normal to the axial direction of the unit to install the cufflink to a shirt cuff. This has for many years been a general construction of cufflinks. The cufflink of abovementioned conventional construction makes troublesome the insertion through cuff button holes of the shank and keeper unit fabricated integrally with the decorative head element. Also, the shank and keeper unit is easily rotated by accidental contact with objects such as clothing, etc. thereby spoiling the wearing appearance of the cufflink and further posing a danger that the cufflink might fall off from the cuff and get lost.

In addition, the conventional cufflink of this type is suitable to be used for those shirts of doubled-back cuffs which are so-called double-cuffed shirts so that it was used originally for these shirts having no buttons installed at the cuffs.

However, in the case of convertible single-cuffed shirts, buttons are already installed in place. As a result, the cufflink of conventional construction showed a disadvantage in that it cannot hide this button thereby degrading the wearing appearance of such a shirt with such cufflinks.

For this reason, the present inventor previously has proposed a cufflink capable of hiding the button of a convertible single-cuffed shirt and of being assembled and disassembled simply by touch, by forming the decorative head element and the shank and keeper unit separately and constructing them so that they can be assembled and disassembled to and from each other freely. See U.S. Pat. No. 4,242,776, issued Jan. 6, 1981 and copending U.S. patent application of Kurashima, Ser. No. 282,929, filed July 13, 1981, now U.S. Pat. No. 4,361,936 issued Dec. 7, 1982.

The prior cufflink of the present inventor is excellent in that it is simply in construction, easy in assembly and disassembly and good in appearance. However, a projection to be fitted by the tip end of the shank portion of its shank and keeper unit is provided on the fixture which is separated from the decorative head element. This increased the parts number by that of the fixture and made it necessary to secure by screws this fixture that is small in size. Further, this screw-installing operation proved to be extremely complicated and troublesome.

SUMMARY OF THE INVENTION

The present design was effected in view of these circumstances. It is intended to provide a cufflink making assembly extremely easy by simplifying the construction and reducing the number of parts.

The cufflink includes a decorative head element disassemblably assembled to a shank and keeper unit.

The decorative head element has a hole in which the shaft head with the aid of a spring which is mounted inside the element. Disassembly is achieved by pushing the two parts together, turning one about the shank a quarter turn and letting go. Within the element cavity a vertical rib is medially formed on the rear wall. The rib is horizontally notched intermediate the opening and edge of the element. The bow of the spring is received in the notch and is resiliently loaded by a retainer located at the bow. The securement plate on which the roundtipped projection is mounted in the cavity so as to project outwardly in the hole is formed as a thin, dished portion of the vertical rib.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION

Figure 1:
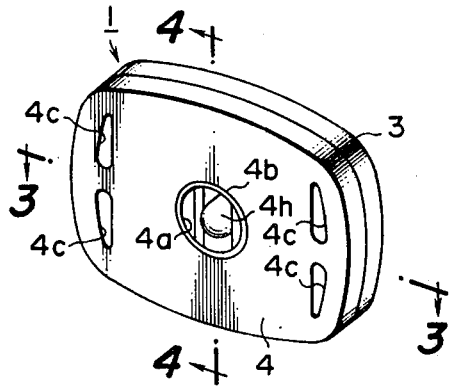
FIG. 1 is a perspective view generally of the rear of the decorative head element of a preferred embodiment of the cufflink of the present invention.
Figure 2:
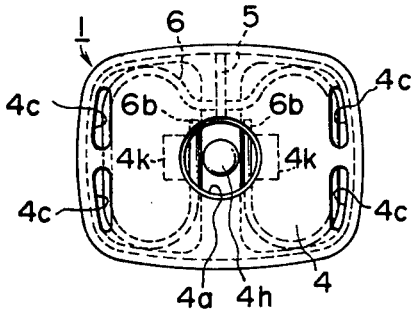
FIG. 2 is a rear elevational view of the decorative head element.
Figure 3:
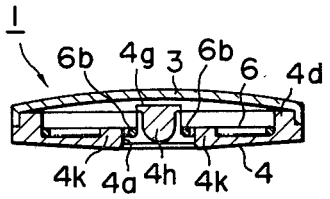
FIG. 3 is a cross-sectional view thereof taken on line 3—3 of FIG. 1.
Figure 4:
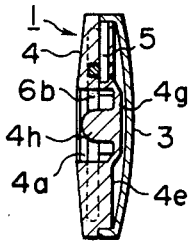
FIG. 4 is a cross-sectional view thereof taken on line 4—4 of FIG. 1.
Figure 5:
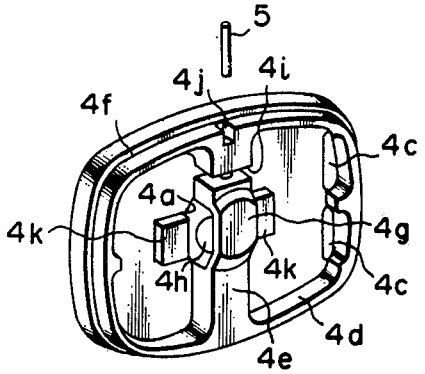
FIG. 5 is an exploded perspective view generally of the normally hidden front of the body of the decorative head element, with the decorative shell removed.
Figure 6:
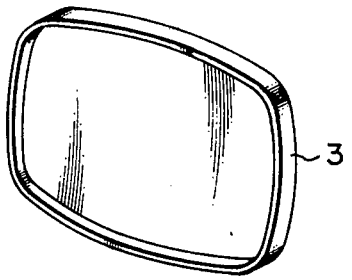
FIG. 6 is a perspective view generally of the normally hidden rear of the decorative shell of the decorative head element.

Hereinbelow, based on the embodiment as shown in drawings, the present design will be described in detail.

In drawings, the numeral 1 indicates the decorative head element, which is formed in the figure of a quadrilateral enclosure. The decorative head element 1 is freely disassemblably assembled with a shank and keeper unit 2 formed separately therefrom, by both of which the cufflink is constituted.

The decorative head element 1 has a generally rectangular shell 3 formed from noble metal, or the like designed properly with one side kept open, to the open side end of which casing 3 a body 4 is fixed by soldering or otherwise. A circular hole 4*a* is formed at the center of the body 4, while a chamfer 4*b* is formed encircling the circular hole 4*a* at the outside surface of the body 4.

A pair of elongated openings 4*c*, 4*c*, one positioned above the other as shown, is formed marginally of each of the longitudinal ends of the body 4, so as to serve for the lessening of the weight of the body 4 and for letting out of any water, or the like which might enter the interior.

A slightly elevated side wall 4*d* is formed at the inside periphery of the body 4 and a center wall 4*e* is formed so as to divide the side wall 4*d* in the traversal direction of the body 4. A comparatively lower step 4*f* is formed outside the side wall 4*d* and throughout the entire circumference thereof and which step 4*f* becomes a part to be fitted by the shell 3.

The center wall 4*e* is formed as high as the side wall 4*d* and has a thin inner portion which closes the circular hole 4*a*. This thin portion is formed into an expansion or securement plate 4*g*, expanding to the interior side of the shell 3. At the opposite side of the expansion 4*g*, a boss 4*h* of the bulletnose figure is formed to be coaxially disposed in the circular hole 4*a*. The boss 4*h* has such a height as to not project axially outside the circular hole 4*a*.

Also, a slot 4*i* having a depth equal to the height of the center wall 4*e* is formed across the center wall 4*e* at a position adjacent to one side of the thin expansion 4*g* of the center wall 4*e*, which slot 4*i* divides the center wall 4*e* into two parts.

In addition, a pilot hole 4*j* of a small diameter is formed so as to communicate through the side wall 4*d*, and into the center wall 4*e* so far as to intersect the slot 4*i* and end near the expansion 4*g*. The pilot hole 4*j* is fitted by the pin 5.

Furthermore, two rectangular projections 4*k* are formed on either side of the center wall 4*e* on the backside of the body 4. The circular hole 4*a*-side edges of the projections 4*k* are disposed in line with the circumference of the circular hole 4*a*, and the distance to the above center wall 4*e* is approximately the same as the size of a fine metal wire which constitutes a spring as described below.

Figure 7:
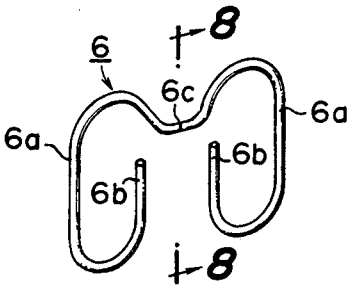
FIG. 7 is a perspective view of the spring normally disposed within the decorative head element.
Figure 8:
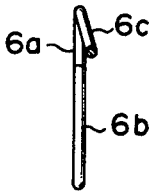
FIG. 8 is a cross-sectional view of the spring taken on line 8—8 of FIG. 7.

The slot 4*i* is used to install a spring 6. The spring 6 is formed approximately in the appearance of an eye glasses frame from a piece of fine metal wire as shown in FIG. 7 and is in possession of sufficient resilience. The spring 6 has leg portions 6*a*, 6*a* of the approximately U-shape, located symmetrically at the left and right sides thereof, the inner end of the leg portion 6*a*, i.e. a straight free end 6*b*, being doubled-back inwardly. Also, at the center of the upper portion of the spring 6, a curved portion 6*c* is formed so as to curve orienting toward the above free end 6*b* and tilt towards the outside thereof. In other words, the plane containing the curved portion 6*c* and the plane containing the leg portions 6*a*, 6*a*, do not share a same plane but intersect each other.

The spring 6 of this construction is installed in position by fitting the curved portion 6*c* into the above slot 4*i*, deforming resiliently by depression the above portion using a fine jig so that the plane containing the curved portion 6*c* and the plane containing the leg portions 6*a*, 6*a* coincide, and driving the pin 5 into the pilot hole 4*j* while keeping the spring so deformed, so that it crosses the slot 4*i* and passes over the curved portion 6*c*. Then, the free end 6*b* is positioned as disposed between the projection 4*k* and the center wall 4*e* at each side of the circular hole 4*a*. This condition means that the curved portion 6*c* is forcibly deflected so that the spring 6 is given a force making it possible to depress the leg portions 6*a*, 6*a* to the backside of the body 4.

Figure 9:
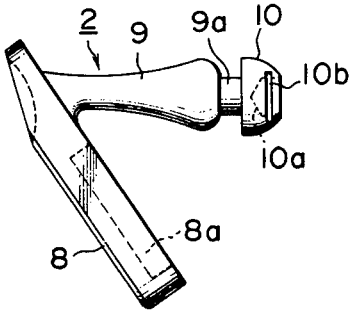
FIG. 9 is a side elevational view of the shank and keeper unit of the preferred embodiment of the cufflink of the present invention.
Figure 10:
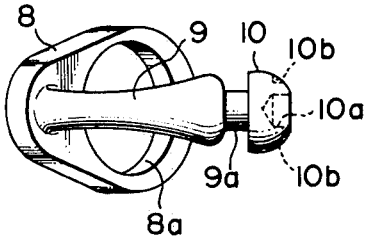
FIG. 10 is a top plan view of the shank and keeper unit of FIG. 9.

The shank and keeper unit 2 preferably has a construction as shown in FIGS. 9 and 10. The shank and keeper unit 2 has a button keeper 8 having a circular recess 8*a* to be fitted by a button and a shank formed integrally therewith at one end thereof so as to be tilted toward the recess 8*a*-side relative to the button keeper 8. Accordingly, when looked at from the side, as is apparent from FIG. 9, the shank and keeper unit 2 shows a construction that the button keeper 8 and the shank 9 are connected to each other in an approximately V-shaped manner.

A semispherical head 10 is formed on the tip end portion of the shank 9, and a pilot hole 10*a* to be fitted by the boss 4*h* formed inside the expansion 4*g* of the body 4 is formed at the center of the tip end of the head 10. Also, slots 10*b*, 10*b*, formed on the positions at both sides of the head 10 sandwich the pilot hole 10*a* and confront each other so as to cross perpendicularly at the direction of the axial line of the shank 9, and to have such a width and depth as to be capable of holding the free ends 6*b*, 6*b*, of the spring 6 respectively.

Furthermore, the head 10 is formed semispherically so that a circular curved surface starts in continuity from approximately the same position as the button keeper 8-side edge of the above slot 10*b*.

Moreover, the base of the head 10 is a flat surface crossing perpendicularly the axial line of the shank 9, and a shaft 9*a* of a small diameter is connected to this base portion. The shaft 9*a* is smaller in diameter than the shank 9 and its length is slightly larger than the thickness of shirt cuff material.

Next, there will be described how to use the cufflink of the present design constructed as disclosed so far.

Figure 11:
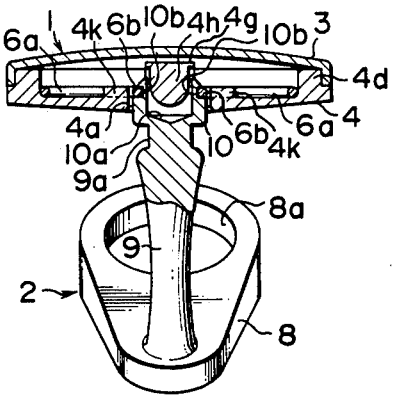
FIG. 11 is a larger-scale end elevational view of the assembled cufflink of the preferred embodiment, with the decorative head element and part of the shank broken away and sectioned to expose internal details.
Figure 12:
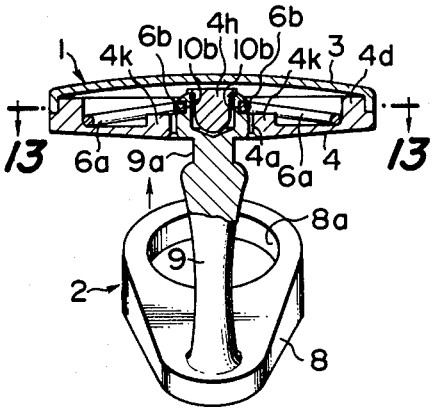
FIG. 12 is a view of the cufflink similar to FIG. 11, but showing the parts as action is begun to remove the decorative head element from the shank and keeper unit.

First, when installing the shank and keeper unit is passed through the two aligned holes of the end of a shirt cuff from inside to outside with the two ends of the cuff overlapped each other, so that the head 10 is disposed at the front side of the cuff. While thus disposed, the head 10 is fitted into the circular hole 4*a* of the decorative head element 1 so that the slots 10*b*, 10*b* of the head 10 confront the free ends 6*b*, 6*b* of the spring 6 respectively. This condition is a condition as shown in FIG. 11. As indicated in the view, a proper fitting can be obtained by fitting the shank 9 into the circular hole 4*a* with the direction in which the button keeper 8 projects relative to the shank 9 crossing perpendicularly the longitudinal direction of the casing 3 of the decorative head element 1. The head 10 is further pushed to travel under this condition. Then, as shown in FIGS. 11 to 12, the free ends 6*b*, 6*b* of the spring 6 are separated further from each other and pushed upward along the curved surface of the semispherical head 10. When the free end 6*b* confronts the slot 10*b*, the free end 6*b* is fitted into the slot 10*b* by a resilience of itself and the boss 4*h* is fitted into the pilot hole 10*a* at the head 10 tip end. This condition is as shown in FIG. 12.

When the depressing force applied on the shank and keeper unit 2 is released under this condition, the free end 6*b* of the spring 6 pushes back the shank and keeper unit 2 with the free end 6*b* fitted in the slot 10*b* since it has a depressing force toward the shell 4 so that the head 10 returns together with the free end 6*b* to the original position relative to the free end 6*b* in the circular hole 4*a*. Under this condition, the free end 6*b* is perfectly fitted in the slot 10*b*. As a result, the head 10 is not prevented from returning into the circular hole 4*a*, the free end 6*b* does not slip out of the slot 10*b* and the shank and keeper unit 2 does not also slip out of the decorative head element 1. In other words, unless pushed toward the shank and keeper unit 2, the decorative head element 1 is not turned to slip out of the mating unit because the free end 6*b* is prevented from its movement by the circular hole 4*a*-side side wall of the projection 4*k*. The foregoing operation is effected simply by a touch.

Figure 13:
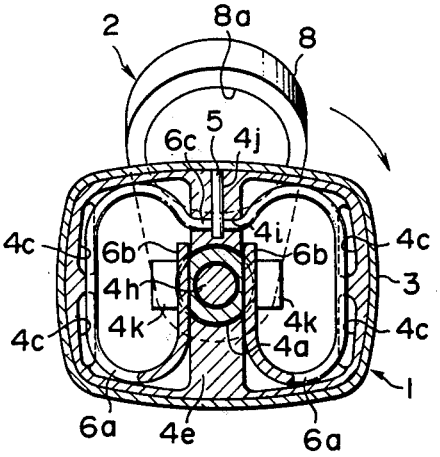
FIG. 13 is a cross-sectional view taken on line 13—13 of FIG. 12.
Figure 14:
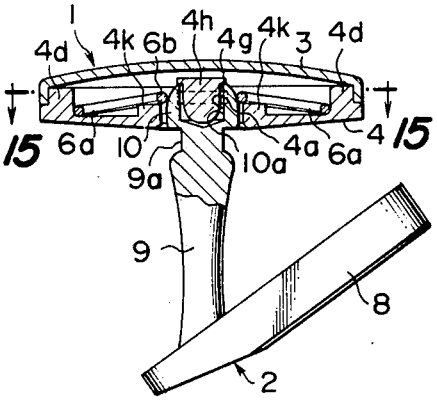
FIG. 14 is a view of the cufflink similar to FIG. 12, but showing the result of the next step, in which the decorative head element is turned ninety degrees about the longitudinal axis of the shank of the shank and keeper unit.
Figure 15:
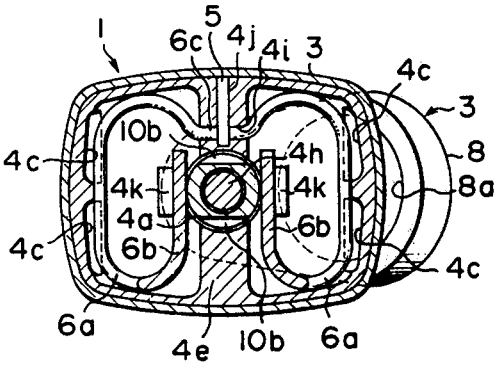
FIG. 15 is a cross-sectional view taken on line 15—15 of FIG. 14.

When desiring to remove the cufflink, the user depresses the decorative head element 1 relative to the shank and keeper unit 2 to push out the free end 6*b* toward the casing 3-side so that it does not make contact with the circular hole 4*a*-side side wall of the projection 4*k*, and thus 90° rotated either rightwise or leftwise relative to the shank and keeper unit 2, as shown in FIG. 13. Then, the free ends 6*b*, 6*b* are caused to leave the slots 10*b*, 10*b* of the head 10 respectively so that they make contact with the circular peripheral surface of the head 10 and are placed on the upper surfaces of the projections 4*k*, 4*k*. This condition is shown in FIG. 14.

Figure 16:
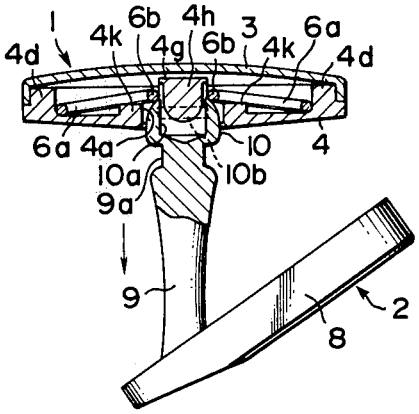
FIG. 16 is a view of the cufflink similar to FIG. 14, but showing the result of initiation of a next step, in which the decorative head element is released to be spring-urged off the tip of the shank of the shank and keeper unit.
Figure 17:
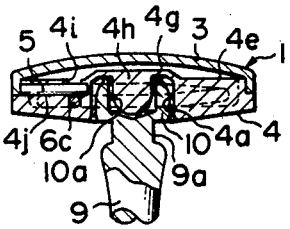
FIG. 17, is a view of the cufflink similar to FIG. 16, but at ninety degrees thereto and showing further progress of the step in which the released decorative head element is free for removal from the tip of the shank of the shank and keeper unit.

The free ends 6*b*, 6*b* are subject to two forces, one by which they attempt to come closer to each other and the other by which they attempt to push out the shank and keeper unit 2, under this condition on one hand, while the curved surface of the slot 10 starts approximately from the same position as the button keeper 8-side edge of the slot 10*b* on the other hand, so that the free end 6*b* slides along the curved surface of the head 10. As a result of this, as shown in FIG. 16, the head 10 is pushed out from the circular hole 4*a* to effect a simple removal of the shank and keeper unit 2. After removal of the unit, the free ends 6*b*, 6*b* are located each between the projection 4*k* and the center wall 4*e*. Installation and removal of the cufflink are executed very easily in this matter.

As is apparent from the description set forth so far, according to the present design, the body 4 constituting the decorative head element 1 is given a construction of entirely integral molding so that it is possible to provide a cufflink which not only allows remarkable reduction of the parts number, makes completely unnecessary the previously-required screw-securing operation of a fixture, etc., simplifies the production process, permits material reduction of the costs, but also allows sure installation and removal by a simple touch and common application to both of the convertible single-cuffed and the doubled-cuffed shirts.

It should now be apparent that the decorative cufflink as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. In a cufflink which is disassemblably assembled of two sub-assemblies constituted by a decorative head element and a shank and keeper unit, wherein:

(a) the decorative head element includes:

(i) a decorative, oblong shell having a front wall and a perimetrical rearwardlyprojecting sidewall, (ii) a body having a rear wall centrally provided with an axially-directed opening, the shell sidewall being perimetrically secured to the body to define within the decorative head element between said front wall, said rear wall and said sidewall an internal cavity;

(iii) a spectacles frame-shaped spring clip having a pair of laterally spaced, generally U-shaped legs having respective free end portions located nearest one another and having respective opposite ends joined by a rim; said rim in the vicinity of said free end portions having an arcuate bridge portion; all of said spring clip but for said bridge portion lying generally in a common plane, and said bridge portion, when free, extending at an acute angle which intersects said common plane where said bridge portion joins the remainder of said rim;

(iv) the body rear wall including means mounting said spring clip by the jamming of said bridge portion into a limited-thickness gap, this gap being capable of receiving said bridge portion only when said rim is resiliently torsionally stressed by an amount sufficient to cause said bridge portion to lie substantially in said common plane, whereby said spring clip is resiliently loaded against the interior of said rear wall of said body;

(v) said spring clip free end portions being juxtaposed with said hole for normally blanking-off two diametrically-opposed perimetrical segments of the hole;

(vi) a securement plate disposed within the cavity in line with said hole, said securement plate having a central, round-tipped projection formed thereon, which projection projects coaxially rearwardly within said hole so as to define an annular well between said projection and said body rear wall within said hole;

(b) the shank and keeper unit includes:

(i) a shank having a head end and a keeper end;

(ii) a keeper secured to the keeper end of the shank;

(iii) the head end having a convexly curved head provided with a diametrically-opposed pair of grooves which extend angularly of the shank, so that when the head end of the shank is thrust into the hole in the rear wall of the body of the decorative head element, the head first deflects the spring clip legs away from the rear wall and their free end portions laterally away from one another, until the free end portions snap into the respective said grooves in said shank head end as torsional stresses stored in said spring clip rim force the spring clip legs back against said rear wall of said body of said decorative head element;

(iv) said shank head end having means defining an axially-opening socket formed therein, which socket receives said projection as said shank head end is inserted through said hole into said annular well;

the improvement wherein:

said means mounting said spring clip includes:

a vertical rib integrally formed medially on said rear wall of said body in said cavity of said decorative head element, said hole opening laterally of said rib by intersection at two laterally spaced sites;

means defining a forwardly opening generally horizontal groove in said rib at an intermediate level between said hole and the perimeter of said rear wall and forming part of said limited-thickness gap for said bridge portion of said rim of said spring clip;

mechanical means received across said groove in front of said bridge portion of said rim of said spring clip for further forming said limited-thickness gap and for retaining said bridge portion of said rim of said spring clip resiliently torsionally stressed so as to lie in said common plane; and said securement plate being formed as an integral, relatively thin portion of said rib.

2. The improved cufflink of claim 1, wherein:

said mechanical means received across said groove is constituted by a pin received in means defining a socket formed vertically into the rib so that said socket intersects the groove intermediate the ends of said socket.

3. The improved cufflink of claim 1, wherein:

the rear wall of said decorative head element is provided internally of said cavity on either side of said rib at the level of said hole with a pair of bosses flanking diametrically opposite sites of said through hole;

each of said U-shaped legs of said spring clip generally encircling a respective said boss, with each free end portion extending laterally between the respective said boss and said rib.

4. The improved cufflink of claim 3, wherein:

said securement plate perimetrically of said round-tipped projection is expanded forwardly so as to base the round-tipped projection closely adjacent the interior of the shell of the decorative head element.

* * * * *